US006086403A

United States Patent [19]

Po et al.

[11] Patent Number: 6,086,403

[45] Date of Patent: Jul. 11, 2000

[54] ELECTRICAL CONNECTOR

[75] Inventors: Li-Ming Po; Yun-San Hsiao, both of Tu-Chen; Jia-Hung Liu, Hsin-Chuang, all of Taiwan

[73] Assignee: Hon Hai Precision Ind. Co., Ltd., Taipei Hsien, Taiwan

[21] Appl. No.: 08/961,633

[22] Filed: Oct. 31, 1997

[30] Foreign Application Priority Data

Dec. 9, 1996 [TW] Taiwan ..... 85219125

[51] Int. Cl.[7] ..... H01R 13/64

[52] U.S. Cl. ..... 439/374; 439/660; 439/680; 439/74

[58] Field of Search ..... 439/374, 680, 439/74, 660, 681

[56] References Cited

U.S. PATENT DOCUMENTS

| | | | |
|---|---|---|---|
| 4,678,121 | 7/1987 | Douty et al. | 439/660 |
| 4,867,699 | 9/1989 | Oda et al. | 439/680 |
| 5,314,356 | 5/1994 | Isohata et al. | 439/680 |
| 5,425,650 | 6/1995 | Maeda | 439/374 |
| 5,655,914 | 8/1997 | McCartin et al. | 439/374 |
| 5,816,842 | 10/1998 | Thantrakul et al. | 439/374 |
| 5,823,815 | 10/1998 | Takata | 439/374 |

*Primary Examiner*—Paula Bradley
*Assistant Examiner*—Katrina Davis

[57] ABSTRACT

A board-to-board connector comprises a female portion, a plurality of conductive contacts, a male portion, and interlocking means provided on the female portion and the male portion. Plate connectors, end walls, and positioning protrusions of the male portion are snugly received in parallel slots, lateral slots, and positioning recesses of the female portion, respectively. Plate connectors of the male portion abut the contacts received in the female portion and positioning protrusions of the male portion interlock with positioning recesses of the female portion thereby establishing and ensuring a consistent electrical connection within the connector.

6 Claims, 6 Drawing Sheets

ELECTRICAL CONNECTOR

BACKGROUND OF THE INVENTION

1. Field of the Invention

The present invention relates to an electrical connector and in particular to a board-to-board electrical connector which interlockingly engages two mating contact portions.

2. The Prior Art

Board-to-board connectors are commonly used to connect two members such as printed circuit boards or a battery supply casing and a printed circuit board. Such connectors usually involve the mating of a male portion with a female portion which are respectively mounted onto each member. Several board-to-board connectors have been previously disclosed including U.S. Pat. Nos. 4,632,475, 4,715,819, 4,975,062, 4,975,067, and 5,551,883. However, these connectors lack an additional engagement means to ensure a consistent electrical connection within the connector therefore resulting in discontinuous communication between the two members.

FIG. 1 shows a typical prior art board-to-board electrical connector comprising a male portion 80 and a female portion 70. The male portion 80 forming a plurality of conductive plate contacts 85 between opposing end walls 83 engages with the female portion 70 defining opposing lateral slots 76 at end positions thereof and a plurality of parallel slots 72 therebetween wherein the end walls 83 and the plate contacts 85 of the male portion 80 are respectively received within the lateral slots 76 and the parallel slots 72 of the female portion 70. A plurality of conductive contacts (not shown) respectively received in the parallel slots 72 of the female portion 70 engage with the plate contacts 85 of the male portion 80 thereby establishing an electrical connection within the connector. The male portion 80 and the female portion 70 are respectively mounted onto two members, e.g. PC boards, to electrically and orthogonally connect the members, as seen in FIG. 2.

Since the structure of the prior art board-to-board connector does not provide any additional engagement feature to ensure a consistent connection within the connector, the stability of the connection is solely dependent upon the precise positioning of the two members being connected. A slight deviation in the placement of the members or a vibration may cause the male portion 80 to rotate with respect to the female portion 70 resulting in an inconsistent electrical contact therebetween. This shortcoming may get worse when these two members are in a mutually perpendicular relationship due to a bending moment occurring thereabout.

Due to the foregoing, it has become desirable to develop a board-to-board electrical connector which includes an additional engagement feature for maintaining a constant electrical connection within the connector.

SUMMARY OF THE INVENTION

An object of the present invention is to provide a board-to-board electrical connector having interlocking means for ensuring the consistency of the electrical connection within the connector.

According to a preferred embodiment of the present invention, a board-to-board electrical connector comprises a female portion and a male portion. The female portion consists of an insulating housing having a top surface and a front surface perpendicular to the top surface. A lateral slot is defined in each outer end of the insulating housing and exposes a front lateral opening in the front surface and a top lateral opening in the top surface. A plurality of equidistantly spaced parallel slots are similarly defined in the insulating housing between the lateral slots. A lateral wall separates each lateral slot from each adjacent parallel slot and separating blocks are interspaced between the parallel slots. Each separating block and one of either lateral wall receives a conductive contact which projects into the adjacent parallel slot whereby only one contact is projected into each parallel slot. Each lateral wall horizontally defines a positioning recess from the front surface to a rear periphery of the lateral slot.

The male portion includes a casing having two opposite end walls joined by a base wall on one side and a rear wall on a perpendicular side. A positioning protrusion having a shape which can be snugly received in the positioning recess defined in each lateral wall of the female portion is formed along a horizontal length of an interior of each end wall parallel to the base wall and contacting the rear wall. A plurality of equidistantly spaced conductive plate contacts having a width equal to or slightly less than the parallel slots of the female portion protrude from the base wall parallel to and between the end walls.

In assembly, the plate contacts, end walls, and positioning protrusions of the male portion are snugly received in the parallel slots, lateral slots, and positioning recesses of the female portion, respectively. The plate contacts of the male portion abut the contacts of the female portion and the positioning protrusions of the male portion interlock with the positioning recesses of the female portion thereby establishing and ensuring a consistent electrical connection within the connector.

In accordance with a second embodiment of the present invention, the positioning recesses of the female portion are vertically defined in each lateral wall from a top surface to a bottom periphery of each lateral slot. The positioning protrusions of the male portion are formed along a vertical height of the interior of each end wall perpendicular to the base wall. The remaining elements of this arrangement are identical to the first embodiment. Likewise, the interlocking means is similarly assembled and produces the same benefit.

A third embodiment of the present invention discloses a first positioning recess and a second positioning recess which are similar to the positioning recess of the first embodiment and the positioning recess of the second embodiment, respectively. The female portion of this structure can interlockingly engage with either male portion described in the first or second embodiments in the same manner of assembly.

Additional objects, features, and advantages of the present invention will become apparent after reading the following detailed description of the embodiments of the invention taken in conjunction with the appended drawing figures.

DETAILED DESCRIPTION OF THE PREFERRED EMBODIMENTS

Detailed reference will now be made to the preferred embodiments of the present invention.

Figure 1:
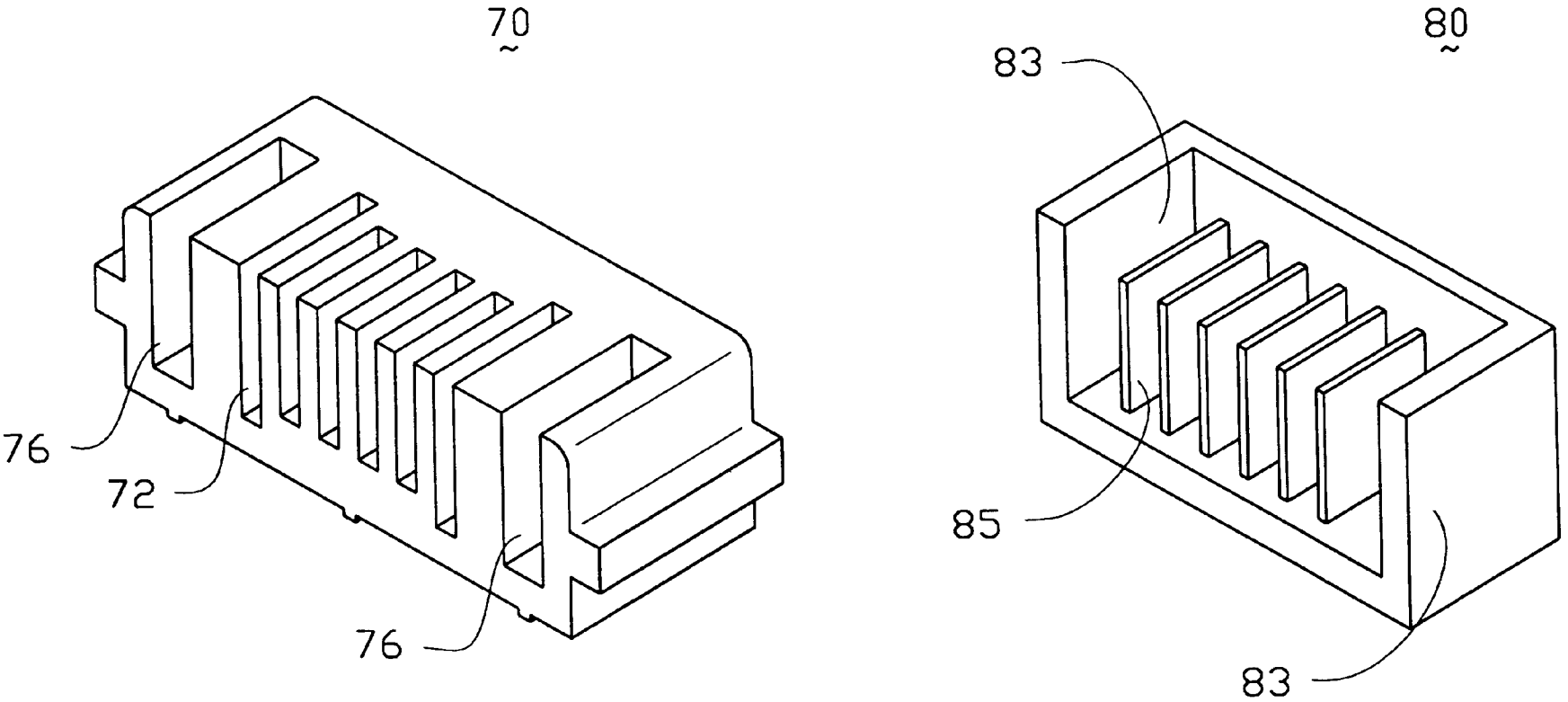
FIG.1 (PRIOR ART)
FIG. 1 is a perspective view of a prior art board-to-board connector.
Figure 2:
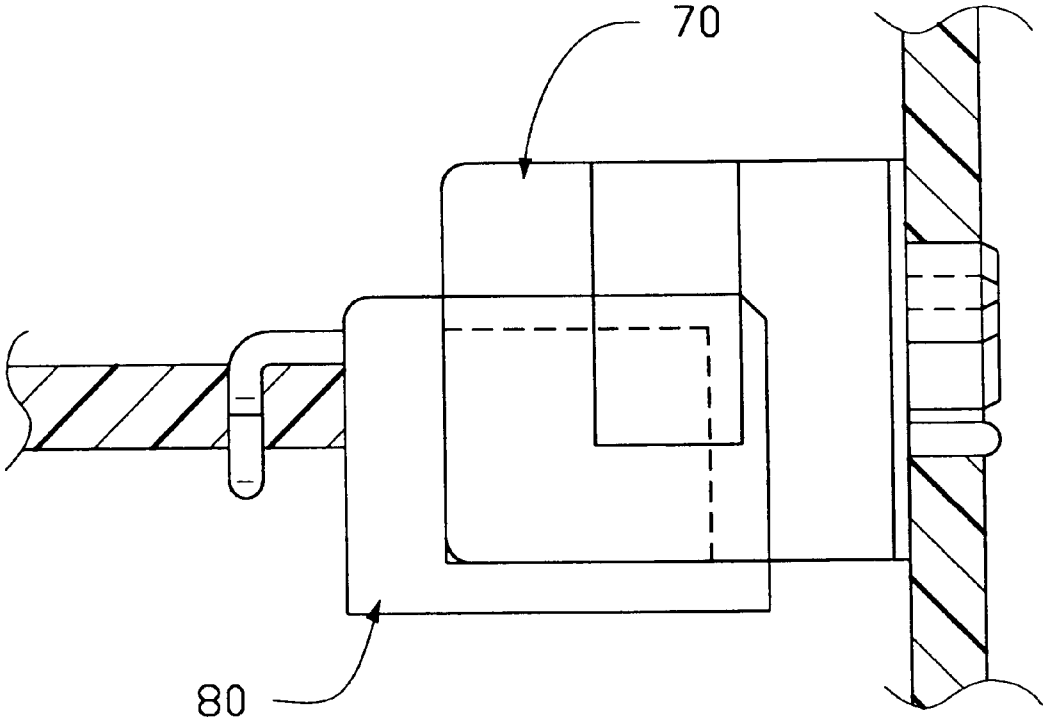
FIG.2 (PRIOR ART)
FIG. 2 is a side view of the assembled prior art connector of FIG. 1.
Figure 3:
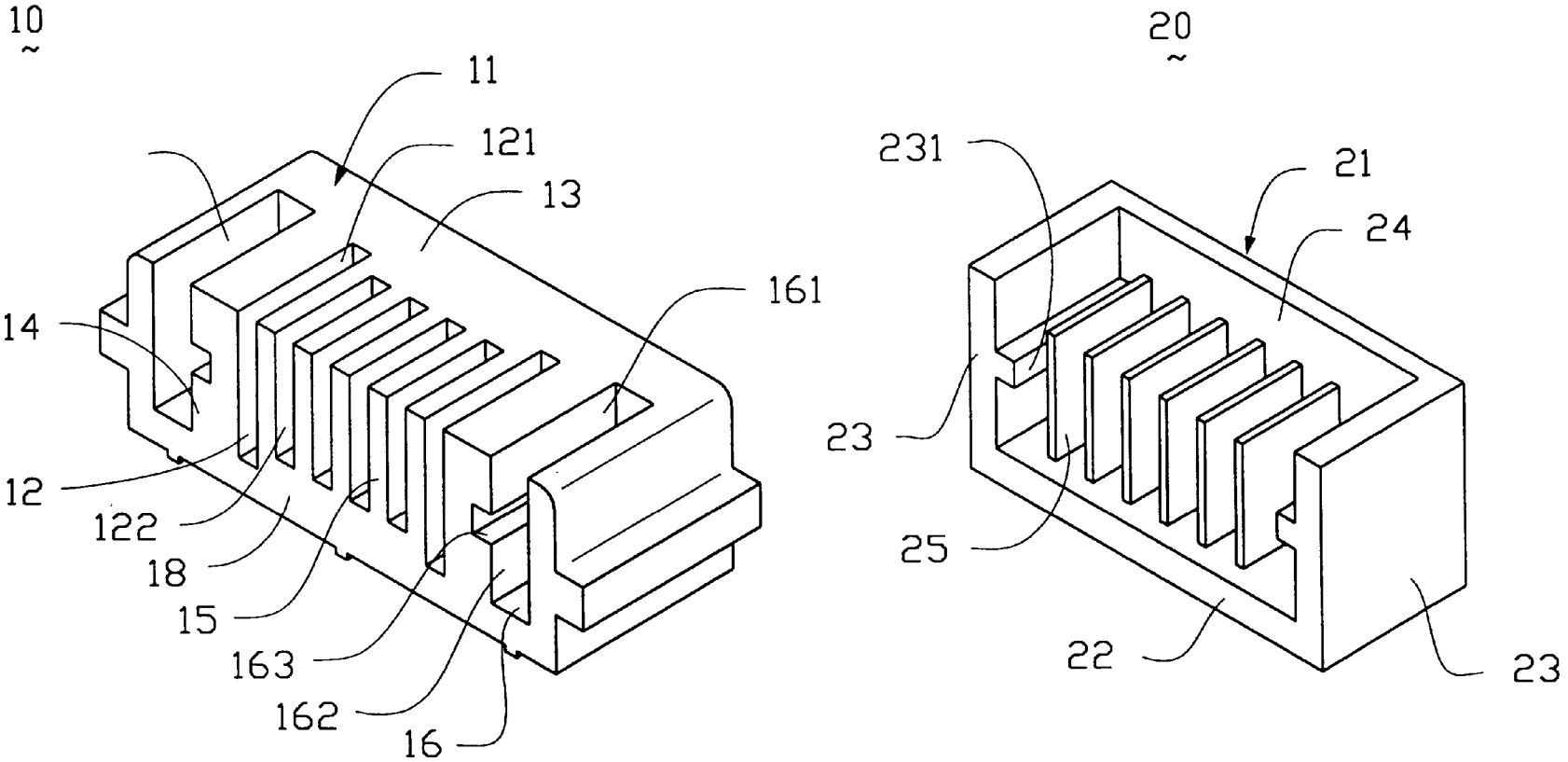
FIG. 3 is a perspective view of the connector in accordance with a preferred embodiment of the present invention.
Figure 4:
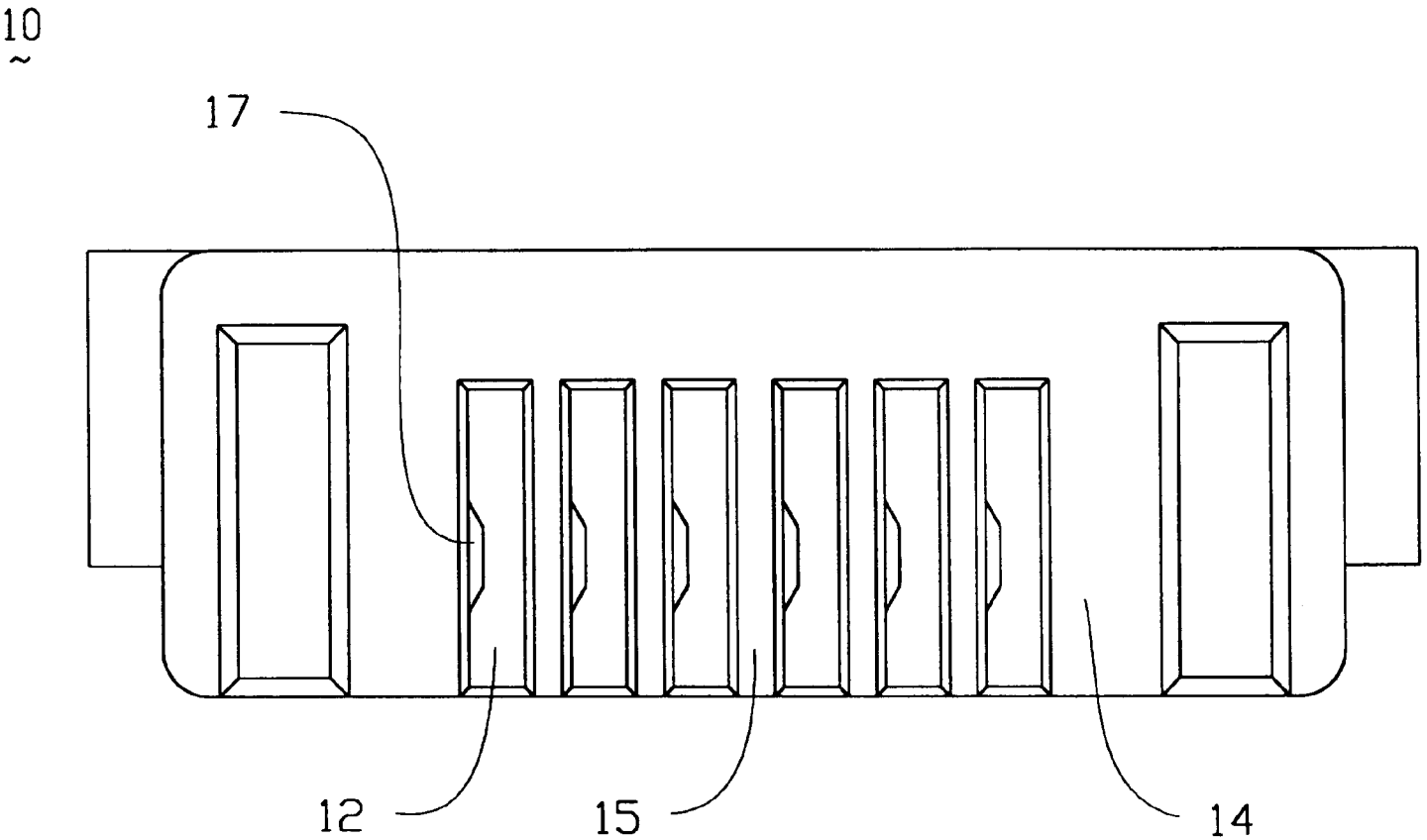
FIG. 4 is a top view of the female portion of the present invention showing an arrangement of conductive contacts.

Referring first to FIG. 3, a board-to-board electrical connector comprises a female portion 10 and a male portion 20. The female portion 10 comprises an insulating housing 11 having a top surface 13 and a front surface 18 perpendicular to the top surface 13. A lateral slot 16 is defined in each outer end of the insulating housing 11 and exposes a front lateral opening 162 in the front surface 18 and a top lateral opening 161 in the top surface 13. A plurality of equidistantly spaced parallel slots 12 are similarly defined in the insulating housing 11 between the lateral slots 16, and expose a front parallel opening 122 in the front surface 18 and top parallel opening 121 in the top surface 13. A lateral wall 14 separates each lateral slot 16 from each adjacent parallel slot 12 and separating blocks 15 are interspaced between the parallel slots 12. Each separating block 15 and one of either lateral wall 14 receives a conductive contact 17 which projects into the adjacent parallel slot 12 whereby only one contact 17 is projected into each parallel slot 12 (seen in FIG. 4). Each lateral wall 14 horizontally defines a positioning recess 163 from the front surface 18 to a rear periphery of the lateral slot 16.

The male portion 20 consists of a casing 21 having two opposite end walls 23 joined by a base wall 22 on one side and a rear wall 24 on a perpendicular side. A positioning protrusion 231 having a shape which can be snugly received in the positioning recess 163 defined in each lateral wall 16 of the female portion 10 is formed along a horizontal length of an interior of each end wall 23 parallel to the base wall 22 and contacting the rear wall 24. A plurality of equidistantly spaced conductive plate contacts 25 having a width equal to or slightly less than the parallel slots 12 of the female portion 10 protrude from the base wall 22 parallel to and between the two end walls 23.

In assembly, the plate contacts 25, end walls 23, and positioning protrusions 231 of the male portion 20 are snugly received in the parallel slots 12, lateral slots 16, and positioning recesses 163 of the female portion 10, respectively. The plate contacts 25 of the male portion 20 abut the contacts 17 of the female portion 10 and the positioning protrusions 231 of the male portion 20 interlock with the positioning recesses 163 of the female portion 10 thereby establishing and ensuring a consistent electrical connection within the connector.

Figure 5:
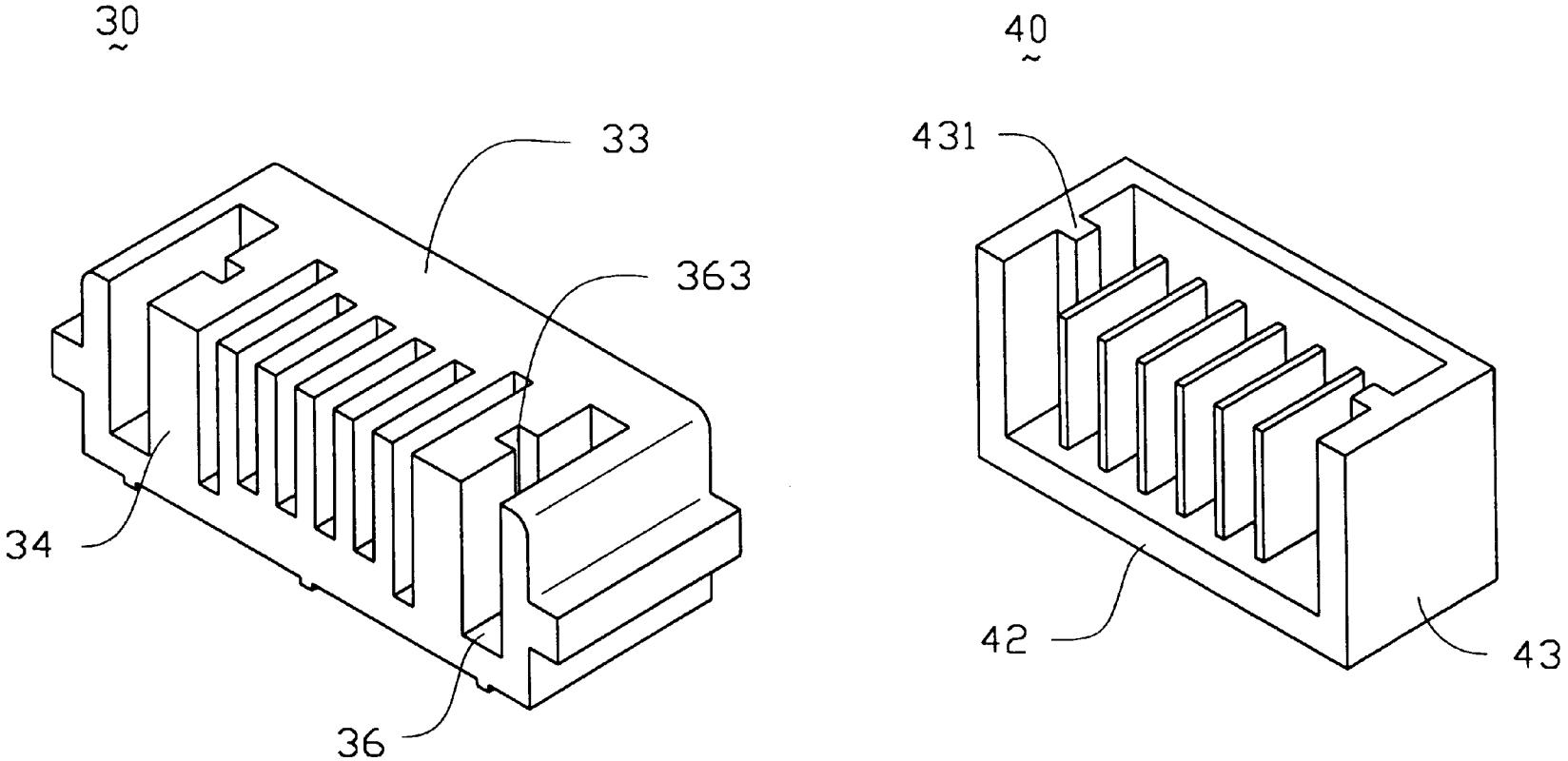
FIG. 5 is a perspective view of the connector according to a second embodiment of the present invention.

FIG. 5 shows a second embodiment of the present invention having basic elements similar to the first embodiment. Positioning recesses 363 of a female portion 30 are each vertically defined in lateral walls 34 from a top surface 33 to a bottom periphery of lateral slots 36. Positioning protrusions 431 of a male portion 40 are each formed along a vertical height of an interior of end walls 43 perpendicular to a base wall 42. The assembly of the interlocking means of this arrangement is similar to the procedure disclosed in the first embodiment and produces the same benefit.

Figure 6:
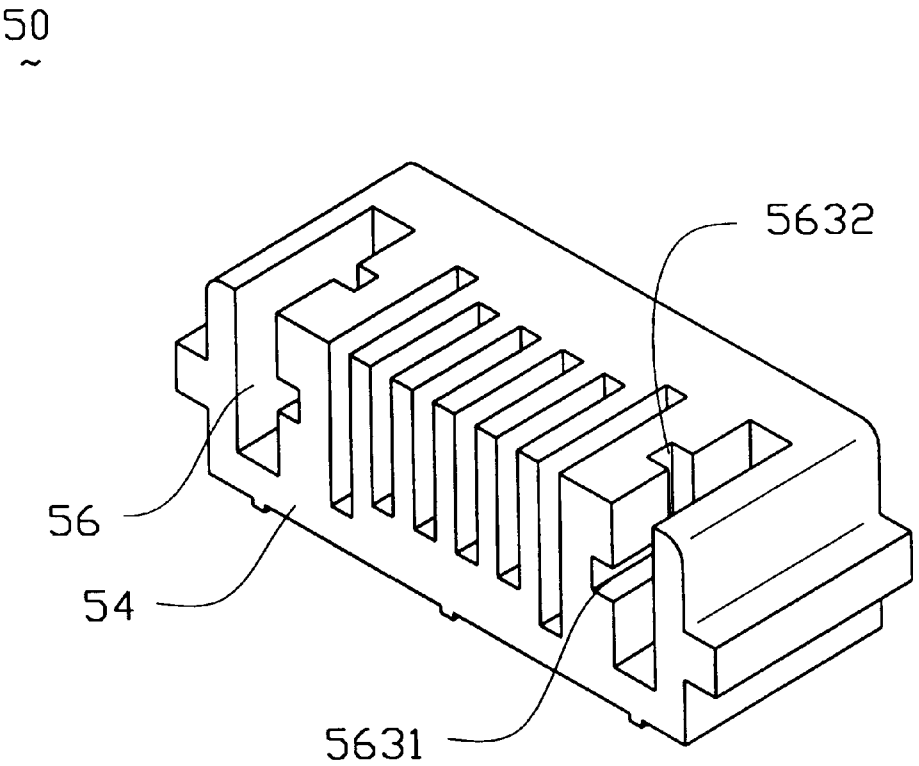
FIG. 6 is a perspective view of the female portion of the present invention in accordance with a third embodiment.

According to a further embodiment of the present invention as illustrated in FIG. 6 which also has basic elements similar to the first embodiment, lateral walls 54 of a female portion 50 each define a first positioning recess 5631 and a second positioning recess 5632 therein. The first positioning recess 5631 and the second positioning recess 5632 are similar to the positioning recess 163 of the first embodiment and the positioning recess 363 of the second embodiment, respectively. The female portion 50 of this structure can interlockingly engage with either male portion 20, 40 described in the first or second embodiments in the same manner of assembly.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A board-to-board connector comprising:

a female portion including an insulating housing having a front surface and top surface perpendicular to the front surface, a lateral slot defined in each outer end of the housing, a plurality of parallel slots defined between said lateral slots, and a lateral wall separating each said lateral slot from each adjacent parallel slot, each slot being exposed to a front parallel opening in the front surface and a top parallel opening in the top surface;

a plurality of conductive contacts received in said housing, one contact projecting into each said parallel slot;

a male portion including a casing having two opposite end walls joined by a base wall on one side and a rear wall perpendicular to the base wall;

a plurality of conductive plate contacts protruding from said casing parallel to and between said end walls said female portion electrically connecting to the male portion with the base wall of the male portion being located above the top surface of the female portion; and interlocking means defining at least one horizontal positioning recess and at least one vertical positioning recess intersecting said at least one horizontal positioning recess in each lateral wall of said female portion, and forming at least one positioning protrusion on each said end wall of said male portion which corresponds to a respective positioning recess, the horizontal positioning recess extending from the front surface of the insulating housing of the female portion to a rear periphery of the lateral slot of the female portion, and the vertical positioning recess extending from the top surface of the insulating housing of the female portion to a bottom periphery of the lateral slot of the female portion and the positioning protrusion being shaped to be snugly received in the respective positioning recess for effectively resisting a bending moment occurring therebetween.

2. The board-to-board connector as described in claim 1, wherein said parallel slots of said female portion are equidistantly spaced between said lateral slots and said plate contacts of said male portion have a width equal to or slightly less than the width of said parallel slots of said female portion.

3. The board-to-board connector as described in claim 1, wherein said positioning protrusion of said interlocking means are shaped to be snugly received in said corresponding positioning recesses.

4. The board-to-board connector as described in claim 3, wherein said interlocking means comprises two first positioning recesses and two second positioning recesses perpendicular to each other.

5. The board-to-board connector as described in claim 4, wherein one of each said first and second positioning recesses is horizontally defined in opposite lateral walls of said female portion and the other of said first and second positioning recesses is vertically defined in opposite lateral walls of said female portion.

6. A board-to-board connector comprising:

a female portion including an insulating housing having a front surface and a top surface perpendicular to the front surface, and a plurality of parallel slots defined for cooperation with a plurality of conductive contacts and a pair of lateral slots at opposite ends thereof, the parallel slots each being exposed to a front parallel opening in the front surface and a top parallel opening in the top surface;

a male portion including a number of plate contacts adapted to be inserted into the corresponding parallel slots and a pair of end walls received in the lateral slots of the female portion, said female portion being electrically connected to the male portion at a position in which the base wall of the male portion is located above the top surface of the female portion; and interlocking means including a first positioning recess horizontally defined in each lateral slot of said female portion and a second positioning recess extending perpendicular to and intersecting the first positioning recess in each lateral slot and a first positioning protrusion horizontally formed on each end wall of said male portion or another male portion including a second positioning protrusion extending formed on each end wall in a direction perpendicular to the direction which the first protrusion extends, the first positioning recess extending from a front surface of the insulating housing of the female portion to a rear periphery of the lateral slot and the second positioning recess extending from the top surface of the insulating housing of the female portion in a direction perpendicular to the first positioning recess to a bottom periphery of the lateral slot, and the first positioning protrusion being shaped to snugly be received in the first positioning recess and the second positioning protrusion being shaped to be snugly received in the second positioning recess for resisting a bending moment occurring between the male and female portions.

* * * * *